US007527179B2

(12) United States Patent
Haimi

(10) Patent No.: US 7,527,179 B2
(45) Date of Patent: May 5, 2009

(54) PUMP CONTAINER LID

(75) Inventor: Shlomo Haimi, 641/10 Balfore St., Or Akiva (IL)

(73) Assignee: Shlomo Haimi, Or Akiva (IL)

( * ) Notice: Subject to any disclaimer, the term of this patent is extended or adjusted under 35 U.S.C. 154(b) by 0 days.

(21) Appl. No.: 10/865,859

(22) Filed: Jun. 14, 2004

(65) Prior Publication Data

US 2005/0274734 A1 Dec. 15, 2005

(51) Int. Cl.
*B65D 88/54* (2006.01)
*B65D 83/00* (2006.01)
*G01F 11/00* (2006.01)
*F04B 39/10* (2006.01)

(52) U.S. Cl. ..... 222/401; 222/321.7; 222/404; 417/546

(58) Field of Classification Search ..... 215/228; 222/401, 400.8, 321.7, 383.2, 383.3, 368, 222/367, 221, 222, 250, 282, 292, 294, 303, 222/308, 309, 314, 321.8, 404; 417/459, 417/523, 546
See application file for complete search history.

(56) References Cited

U.S. PATENT DOCUMENTS 4,823,968 A * 4/1989 Handzlik ..... 215/228
5,152,425 A * 10/1992 Baudin ..... 222/1
5,406,992 A * 4/1995 Miramon ..... 141/65
5,535,900 A * 7/1996 Huang ..... 215/228
5,992,666 A * 11/1999 Wu ..... 220/212
6,637,321 B2 * 10/2003 Wang ..... 99/472
6,880,731 B2 * 4/2005 Heukamp ..... 222/321.7

* cited by examiner

*Primary Examiner*—Kevin P Shaver
*Assistant Examiner*—Melvin A Cartagena
(74) *Attorney, Agent, or Firm*—Mark M. Friedman

(57) ABSTRACT

The present invention is a container lid assembly that includes an integral pump. A main feature of the present invention is a pump configuration that activates the reciprocating linear motion of the piston portion of the pump by the rotational movement of a pump actuating element that is interconnected to the piston portion. The pump configuration of the present invention may be configured so as to create at least a partial vacuum within the container. Alternatively, the pump configuration may be configured so as to pressurize the interior volume of the container. The lid consists of two major pieces, a seat portion that includes the pump cylinder, and a rotatable piston portion that includes the pump piston and the interconnected piston actuating element section. In preferred embodiments of the present invention, the pump piston and the piston actuating element section are integrally formed. The rotatable piston portion is rotatably attached to the seat portion such that rotation of the rotatable piston portion effects linear displacement of the rotatable piston portion with regard to the seat portion.

16 Claims, 6 Drawing Sheets

PUMP CONTAINER LID

FIELD AND BACKGROUND OF THE INVENTION

The present invention relates to container lids and, in particular, it concerns a container lid having an integral pump feature.

It is known to provide container lids configured to pump gases, usually air, into a container in order to pressurize the interior volume. It is also know to provide container lids configured to pump gases out of the interior volume of a container in order to create at least a partial vacuum within the interior volume.

Within the category of lids configured to pressurize the interior volume of the container the pump inset of U.S. Pat. No. 5,823,372 to Levine, provides a pump adapted for insertion between a cap and a carbonated-beverage bottle for re-pressurizing the interior of the bottle with air. The pump is comprised of a hollow, resilient, expandable and compressible body that is placed into the region between the cap and the bottle, and is operated by an up-down motion initiate by the user.

U.S. Pat. No. 6,352,165 discloses an apparatus for sealing and pressurizing a bottle. The cap section of the device forms a chamber adapted to receive at least a portion of external threads of the bottle in order to detachably mount the apparatus on the bottle. An annular compressing plate is mounted in the cap section so as to be movable upwardly or downwardly therein. This compressing plate is non-rotatable relative to the cap section. A resilient, expandable and compressible bellows is located above the compressing plate and around the cap section. There is an exterior cover member that has a cylindrical side wall with interior threads in operative engagement with the edge of the plate. Rotation of the cover member to a sufficient extent causes the bellows to be compressed by upward movement of the plate. Therefore, the pressure generated by this device is limited to the amount of pressure generated by a single compression of the bellows.

Within the category of lids configured to create a vacuum within the interior volume of the container, several bottle cap devices are know that are configured for use in conjunction with a separate pump such that once the vacuum is created, the pump is disconnected from the cap. These devices suffer from the need to store the pump while not in used and prevent loss of the pump during such storage. Further, some of the dump mechanisms for devices of this type are expensive electrical devices that are inappropriate for consumers with a small number of containers requiring vacuum sealing.

One attempt to provide a bottle cap with an integral vacuum pump is disclosed in U.S. Pat. No. 6,637,321 to Wang. Wang's cap includes a piston style pump, the cylinder of which is deployed inside of the container on which the cap is deployed. A handle is formed on the exposed end of the piston, and the pump is operated by a push-pull motion. One drawback to this style of pump is the length of piston stroke necessary for efficient pumping. Therefore, the cylinder extends relatively far into the container, or in the case of U.S. Pat. No. 5,535,900 to Huang, the pump extends above the bottle.

It is noteworthy that the above referenced devices do not suggest that the device is easily convertible to perform the opposite function. That is, that a lid designed to pressurize the interior of the container may be easily converted so as to create vacuum, and vise versa.

There is therefore a need for a container lid assembly with an integral pump, in which the reciprocating linear motion of the piston is actuated by rotational movement of a pump actuating element. It would beneficial if the lid could be alternatively configurable so as to pressurized the interior of the container, or create at least a partial vacuum within the interior of the container.

SUMMARY OF THE INVENTION

The present invention is a container lid having an integral pump feature.

According to the teachings of the present invention there is provided, a pump lid assembly for use with a container, the lid assembly comprising: (a) a seat-portion for sealing connection to the container; (b) a pump cylinder configuration associated with the seat-portion; and (c) a rotatable piston portion mechanically associated with the pump cylinder, thereby defining between them a variable pump volume; wherein the association is such that rotation of the rotatable piston portion in a first rotational direction generates linear motion of the rotatable piston portion in a first linear direction and rotation of the rotatable piston portion in a second rotational direction generates linear motion of the rotatable piston portion in a linear direction substantially opposite to the first linear direction, thereby alternatingly increasing and decreasing the variable pump volume, and causing displacement of gases between an interior volume of the container and an exterior atmosphere.

According to a further teaching of the present invention, an actuating element section of the rotatable piston portion substantially circumscribes at least a portion of the pump cylinder such that the rotation is about the pump cylinder.

According to a further teaching of the present invention, one of the pump cylinder and the rotatable piston portion includes at least one angled groove, and the other of the pump cylinder and the rotatable piston portion includes at least one pump activation pin configured to engage the angled groove, such that during the rotation the activation pin contacts an edge of the angled groove, thereby generating the linear motion.

According to a further teaching of the present invention, there is also provided, a lid-removal mechanism configured to selectively limit rotation of the rotatable piston portion in relation to the seat-portion.

According to a further teaching of the present invention, the lid-removal mechanism is engaged by fully displacing the rotatable piston portion in a direction longitudinally away from the container so as to engage complementary teeth configured in both the actuating element and the seat-portion.

According to a further teaching of the present invention, there is also provided; (a) at least one first valve configured to allow unidirectional flow of gas between the variable pump volume and an interior volume of the container; and (b) at least one second valve configured to allow unidirectional flow of gas between the variable pump volume and an external atmosphere; wherein the alternatingly increasing and decreasing the variable pump volume causes displacement of gases through the first and the second valves.

According to a further teaching of the present invention, the at least a first valve and the at least a second valve are configured so as to pump gases out of the interior of the container and into the exterior atmosphere, thereby creating at least a partial vacuum within the interior of the container.

According to a further teaching of the present invention, the at least a first valve and the at least a second valve are configured so as to pump gases from the exterior atmosphere into the interior of the container, thereby pressurizing the interior of the container to a level above atmospheric pressure.

There is also provided according to the teachings of the present invention, a method for actuating a pump lid assembly for use with a container, the method comprising: (a) providing a seat-portion for sealing connection to the container; (b) providing a pump cylinder configuration associated with the seat-portion; (c) providing a rotatable piston portion mechanically associated with the pump cylinder, thereby defining between them a pump volume, the association being such that rotation of the rotatable piston portion in a first rotational direction generates linear motion of the rotatable piston portion in a first linear direction and rotation of the rotatable piston portion in a second rotational direction generates linear motion of the rotatable piston portion in a linear direction substantially opposite to the first linear direction, thereby alternatingly increasing and decreasing the pump volume, and causing displacement of gases between an interior volume of the container and an exterior atmosphere; and (d) alternately rotating the rotatable piston portion in the first and the second rotational directions.

According to a further teaching of the present invention, there is also provided, circumscribing at least a portion of the pump cylinder with an actuating element section of the rotatable piston portion substantially such that the rotation is about the pump cylinder.

According to a further teaching of the present invention, there is also provided providing one of the pump cylinder and the rotatable piston portion with at least one groove, and providing the other of the pump cylinder and the rotatable piston portion with at least one pump activation pin configured to engage the groove, such that during the rotation the activation pin contacts an edge of the groove, thereby generating the linear motion According to a further teaching of the present invention, there is also provided providing a lid-removal mechanism configured to selectively limit rotation of the rotatable piston portion in relation to the seat-portion.

According to a further teaching of the present invention, engaging the lid-removal mechanism includes displacing the actuating element a pre-limited distance in a direction longitudinally away from the container and displacing at least a portion of the actuating element inward toward the seat-portion so as to engage complementary teeth configured in both the actuating element and the seat-portion.

According to a further teaching of the present invention, there is also provided; (a) providing at least one first valve configured to allow unidirectional flow of gas between the pump volume and an interior volume of the container; and (b) providing at least one second valve configured to allow unidirectional flow of gas between the pump volume and an external atmosphere; wherein the alternatingly increasing and decreasing the pump volume causes displacement of gases through the first and the second valves.

According to a further teaching of the present invention, there is also provided configuring the at least a first valve and the at least a second valve are configured so as to pump gases out of the interior of the container and into the exterior atmosphere, thereby creating at least a partial vacuum within the interior of the container.

According to a further teaching of the present invention, there is also provided configuring the at least a first valve and the at least a second valve are configured so as to pump gases from the exterior atmosphere into the interior of the container, thereby pressurizing the interior of the container to a level above atmospheric pressure.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a container lid having an integral pump feature.

The principles and operation of a container lid according to the present invention may be better understood with reference to the drawings and the accompanying description.

By way of introduction, the present invention is a container lid assembly that includes an integral pump. A main feature of the present invention is a pump configuration that activates the reciprocating linear motion of the piston portion of the pump by the rotational movement of a pump actuating element that is interconnected to the piston portion. As will be discussed below, the pump configuration of the present invention may be configured so as to create at least a partial vacuum within the container, FIGS. 1-5. As used herein, the terms "vacuum" and "partial vacuum" are used interchangeably and are consider to be synonymous, referring to any state of partial vacuum up to and including a state of complete vacuum. Alternatively, the pump configuration may be configured so as to pressurize the interior volume of the container, FIG. 6.

The lid consists of two major pieces, a seat portion that includes the pump cylinder, and a rotatable piston portion that includes the pump piston and the interconnected piston actuating element section. In preferred embodiments of the present invention, the pump piston and the piston actuating element section are integrally formed. The rotatable piston portion is rotatably attached to the seat portion such that rotation of the rotatable piston portion effects linear displacement of the rotatable piston portion with regard to the seat portion.

Figure 1:
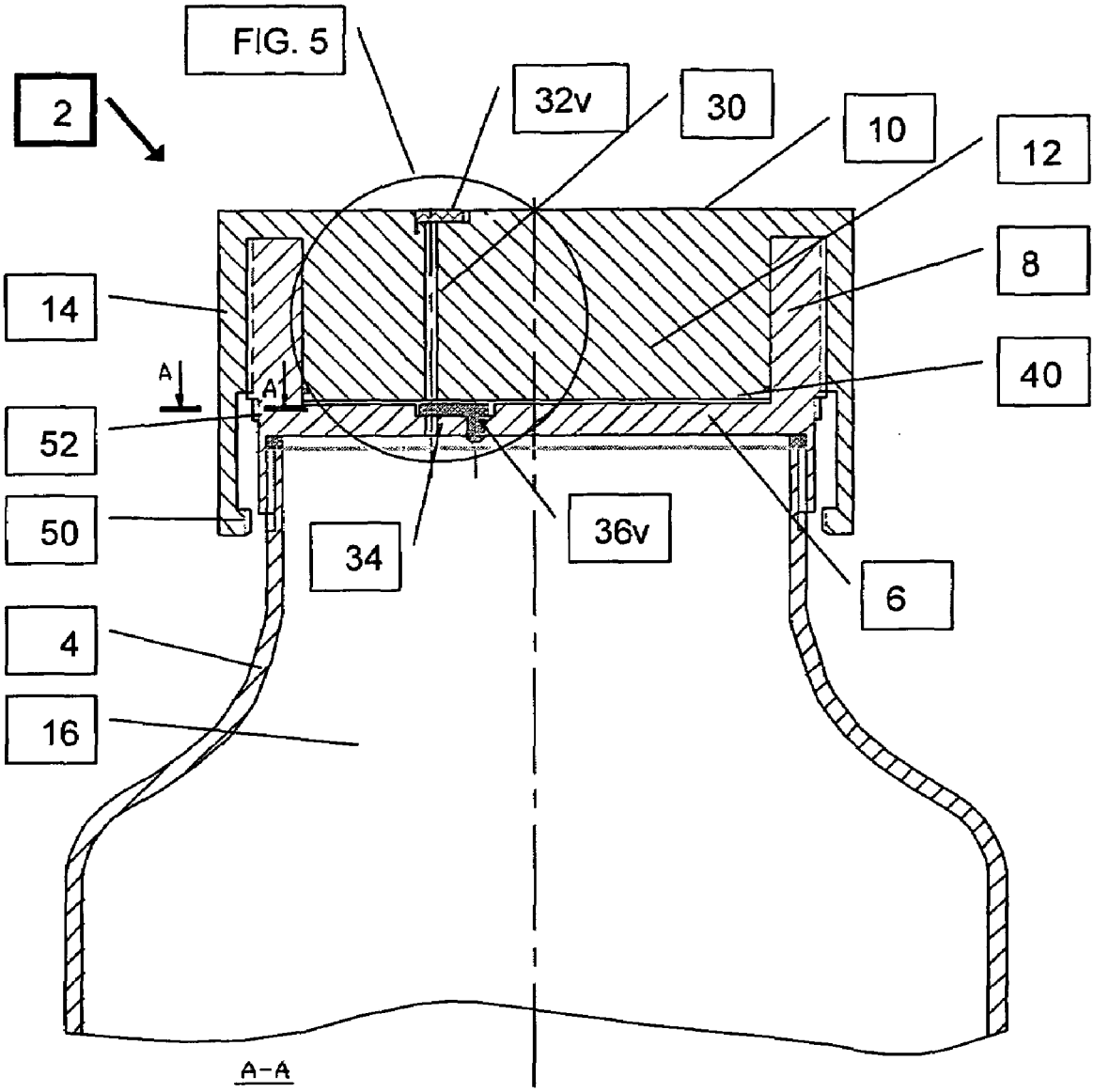
FIG. 1 is a side cross section of a first preferred embodiment of a lid constructed and operative according to the teachings of the present invention, shown mounted on a container, configured to create a vacuum within the interior volume of the container.

Referring now to the drawings, FIG. 1 illustrates a first preferred embodiment of a pump lid of the present invention, generally referred to as 2, that is attached to a container 4. The seat portion 6 of the pump lid 2 may be attached to the container 4 in substantially any fashion known in the art. The seat portion is configured so as to include a substantially cylindrical pump cylinder 8. The rotatable piston portion 10 includes the pump piston 12 and the piston actuating element section 14, which are interconnected. In the preferred embodiments illustrated herein, the interconnection is by way of integral formation as a single molded piece. The pump piton 12 is deployed within the pump cylinder, while the piston actuating element section 14 extends beyond the wall of the pump cylinder so as to substantially circumscribe at least a portion of the pump cylinder. Therefore, the piston actuating element section 14 is rotated about the pump cylinder.

Figure 2:
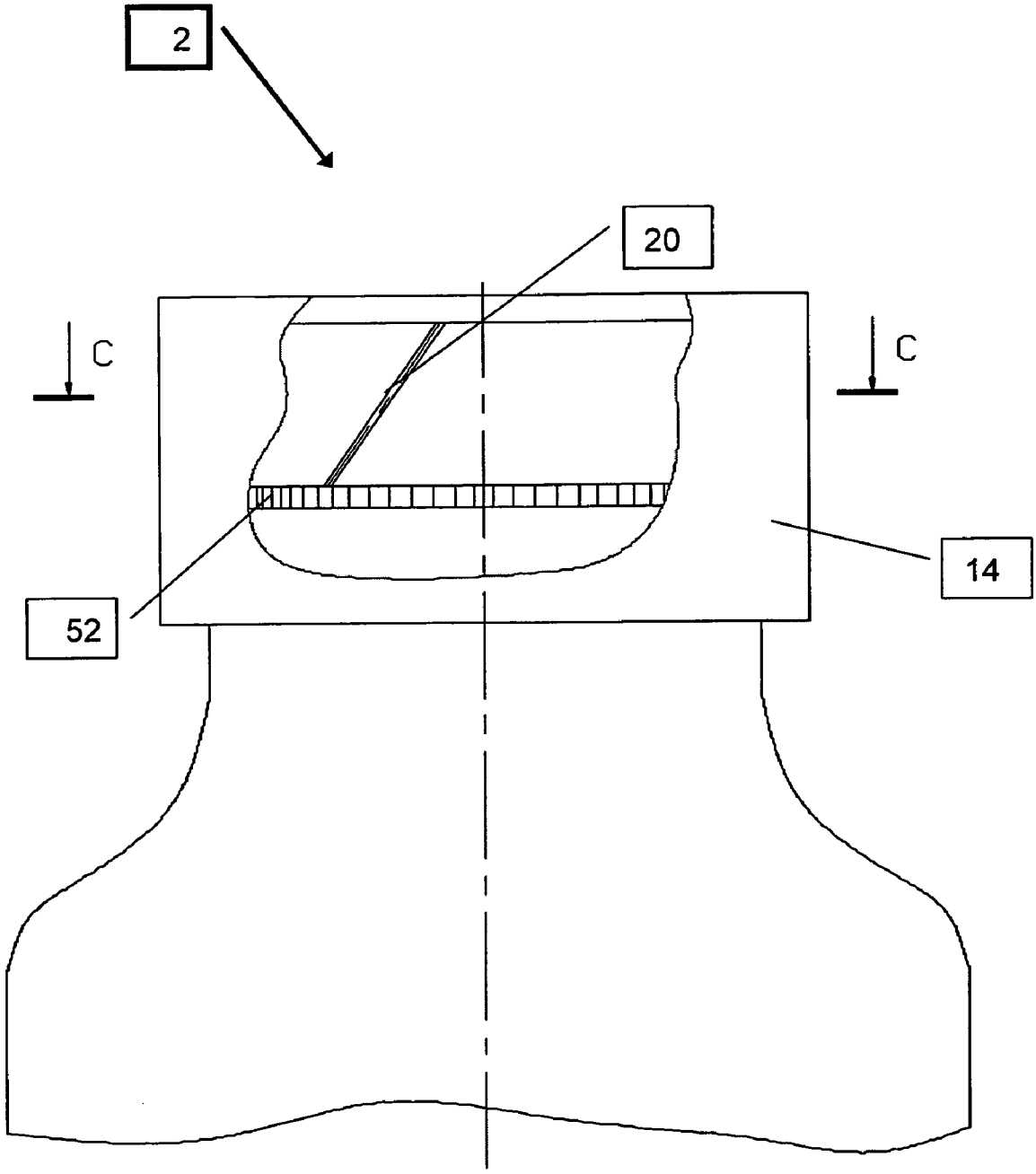
FIG. 2 is partial cut-away side view of the embodiment of FIG. 1, showing a pump activating groove.
Figure 3:
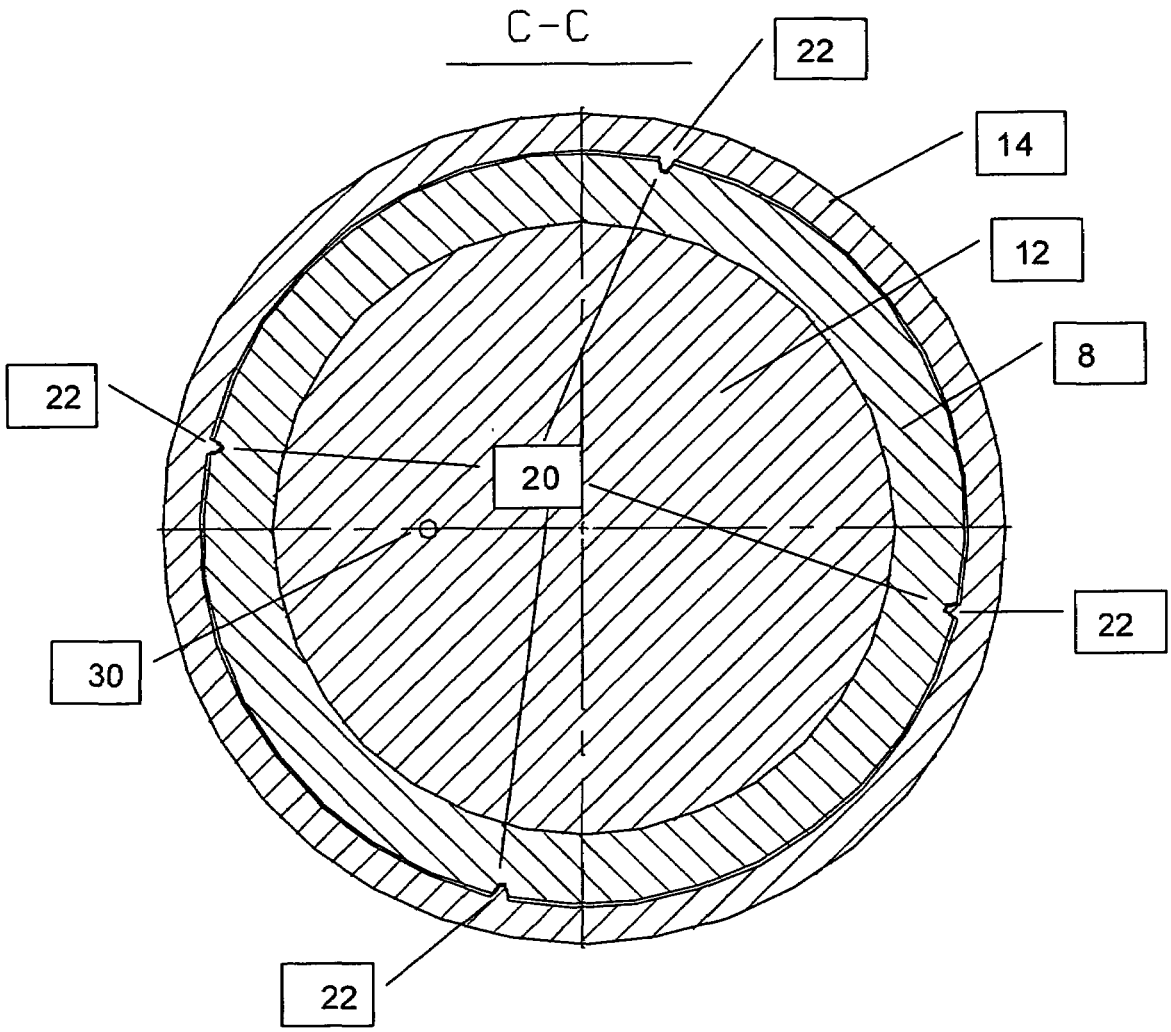
FIG. 3 is a cross section taken along line C-C of FIG. 2.

As illustrated in FIGS. 2 and 3, the outer surface of the pump cylinder wall 8 includes at least one and preferably four angled grooves 20 configured at an angle to the direction of rotation of the rotatable piston portion 10. The surface of the piston actuating element section 14 that abuts the outer surface of the pump cylinder wall 8 includes at least one and preferably four pump activation pins 22 configured to engage the angled grooves 20, such that during rotation the activation pins 22 contact the edges of the angled grooves 20, thereby generating linear motion of the rotatable piston portion 10. Alternately, the outer surface of the pump cylinder wall 8 may include the pump activation pins 22, and the grooves 20 may be configured in the surface of the piston actuating element section 14 that abuts the outer surface of the pump cylinder wall 8. Preferably, the angle of the angled grooves 20 is such that full linear displacement of the piston 12 is actuated by a rotation of about one-quarter of a turn of the rotatable piston portion 10 about the pump cylinder 8. It should be noted that according to the principles of the present invention, full displacement of the piston 12 may be achieved by substantially any amount of rotation. That is, the angle of the angled grooves 20 in relation to the direction of rotation of the rotatable piston portion 10 may be of substantially any suitable angle.

As illustrated here, rotation of the rotatable piston portion 10 in a counter-clockwise direction generates linear motion of the rotatable piston portion 10 in a direction away from the seat portion of the lid. Therefore, clockwise rotation of the rotatable piston portion 10 generates linear motion of the rotatable piston portion 10 in a linear direction toward the seat portion of the lid. It will be appreciated that the angled grooves 20 may be configured such that clockwise rotation will generate movement away from the seat portion 6 and counter-clockwise rotation will generate movement toward the seat portion 6.

Figure 4:
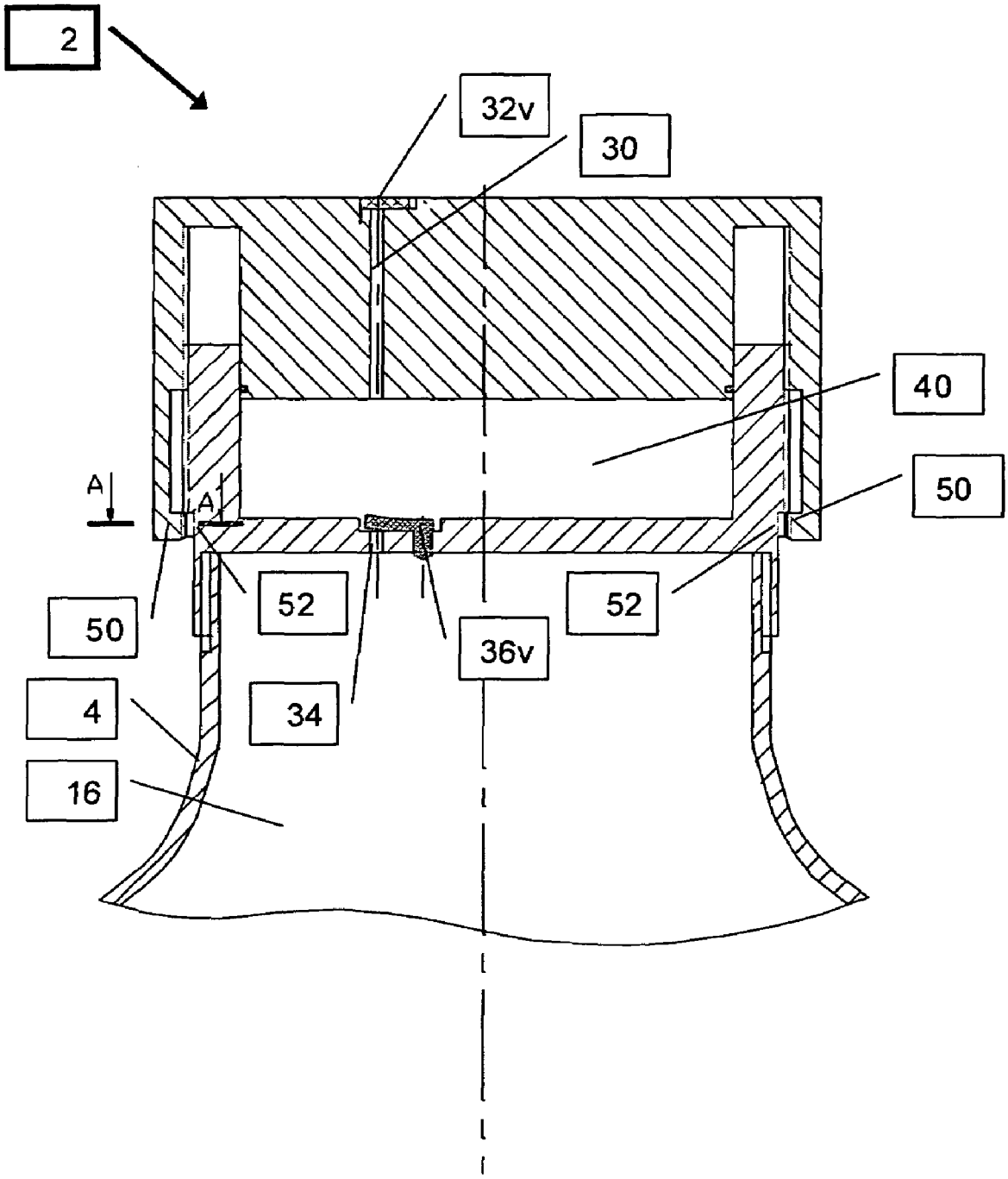
FIG. 4 is a side cross section of the embodiment of FIG. 1, showing the piston is a raised position.
Figure 5:
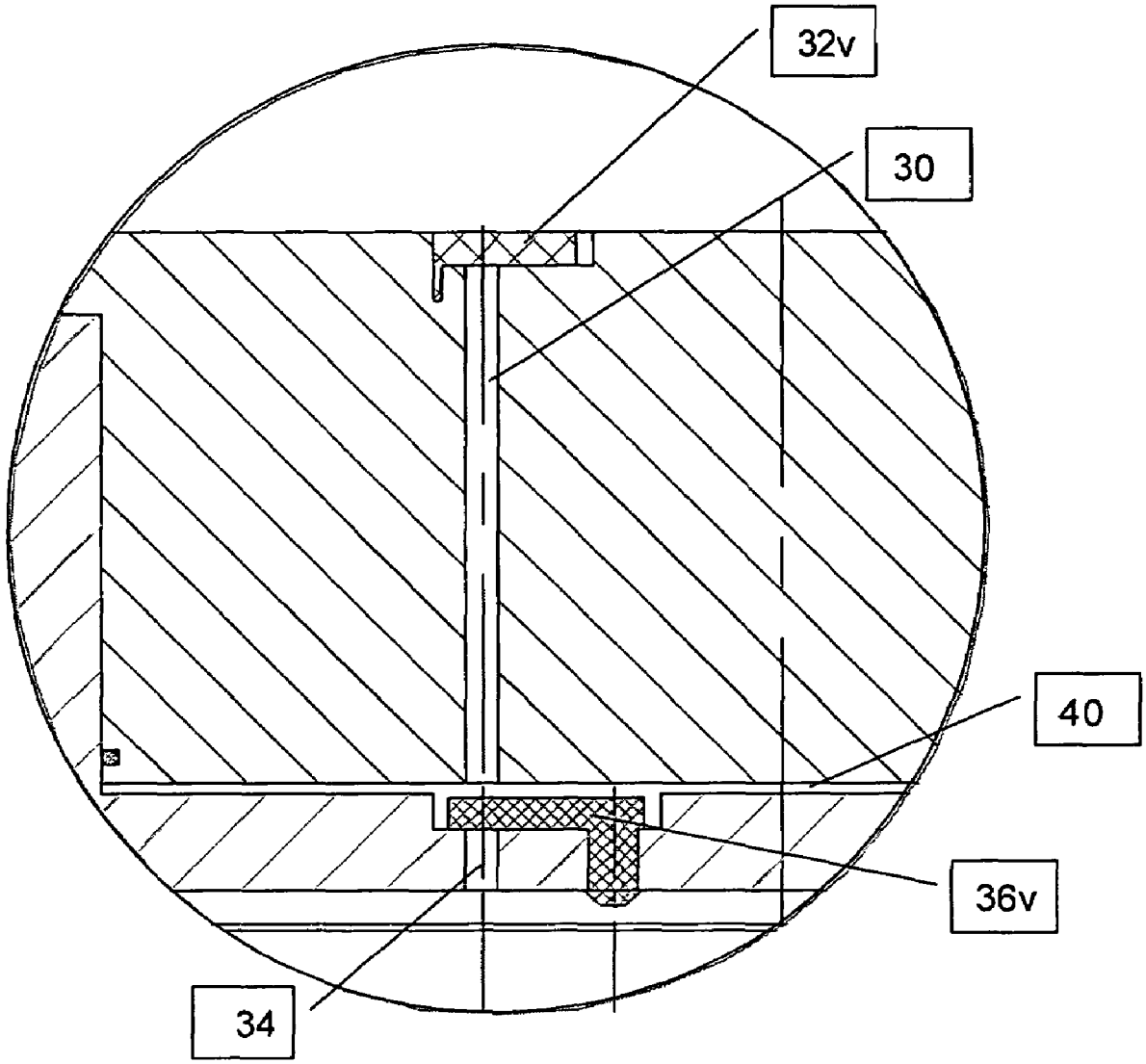
FIG. 5 is a detail of FIG. 1, showing the valve configuration.
Figure 6:
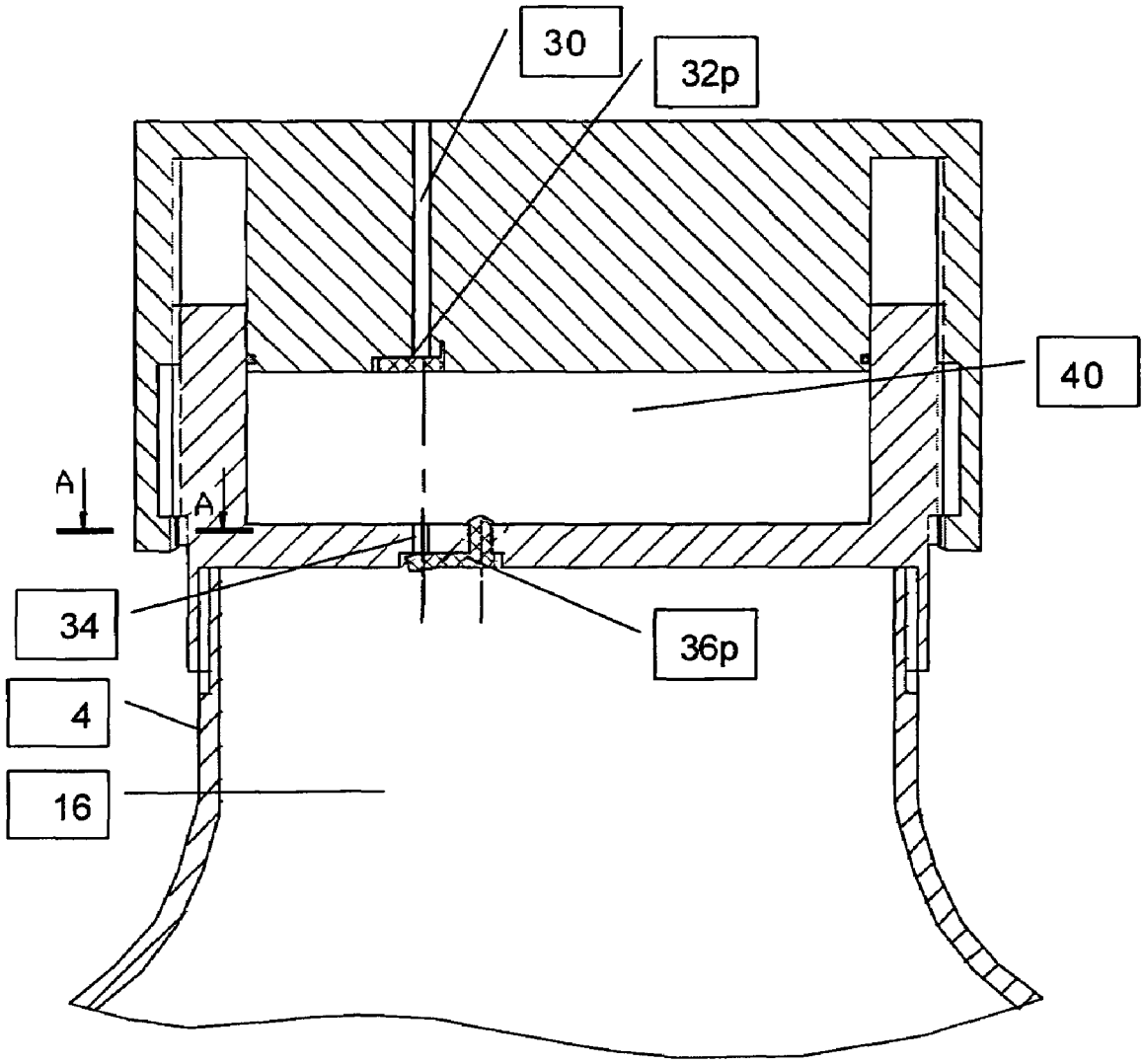
FIG. 6 is a side cross section of a second preferred embodiment of a lid constructed and operative according to the teachings of the present invention, shown mounted on a container, configured to pressurize the interior volume of the container.

The rotatable piston portion 10 illustrated herein includes a passageway 30 that allows fluid communication between the variable pump volume 40 and the exterior atmosphere. The seat portion 6 of the lid 2 includes a passageway 34 that allows fluid communication between the variable pump volume 40 and the interior 16 of the container. As illustrated in FIGS. 4 and 6, the passageways 30 and 34, may be configured with valves 32 and 36. Valves 32*v* and 36*v*, as seen in FIGS. 1, 4 and 5 are one-way flap valves configured such that gases are pumped out of the interior volume 16 the container 4, thereby creating a vacuum within the container. One-way flap valves 32*p* and 36*p*, as seen in FIG. 6, are configured such that gases are pumped into of the interior volume 16 the container 4, thereby pressurizing the interior volume 16 container 4 to a level above atmospheric pressure. It should be noted that substantially any suitable unidirectional valve may be used in association with passageways 30 and 34.

It is noteworthy that the pump configuration of the present invention may be configured to either pump gases into or out of the container merely by altering the valve arrangement, with substantially no other changes to the major components of the lid. A lid configured such that the end user may change the deployment of the valves so as to alternate between pumping gases in and pumping gases out of the container is within the scope of the present invention.

Operation of the preferred embodiment of the pump configuration of the present invention illustrated herein is as follows:

1—Turning of the rotatable piston portion 10 of the lid 2 in a counter-clockwise direction causes the piston 12 to move linearly away from the seat portion 6 of the lid 2, increasing the volume of the variable volume 40 of the pump, thereby drawing gases into the variable volume 40 of the pump. Rotation of about one quarter of a turn provides substantially full displacement of the piston 12.

2—Turning of the rotatable piston portion 10 of the lid 2 in a clockwise direction causes the piston 12 to move linearly toward the seat portion 6 of the lid 2, decreasing the volume of the variable volume 40 of the pump, thereby exhausting gases form the variable volume 40 of the pump.

3—Repetition of the turning motions causes continued pumping action until the desired pressure within the interior of the container is reached. If the valves 32 and 36 are configured to pump gases out of the container, as in FIG. 4, then a vacuum state will be achieved. Alternately, if the valves 32 and 36 are configured to pump gases into of the container, as in FIG. 6, then a pressurized state will be achieved.

It should be noted that the mechanical advantage of the inclined plan of the groove allows the pump of the present invention to achieve pressure changes equal to or greater than manual pump devices of prior art, with less physical output from the user. Further, users with limited strength, such as older persons, may achieve pressure changes using the lid of the present invention that would be unattainable for them using manual pump devices of prior art.

Figure 1A:
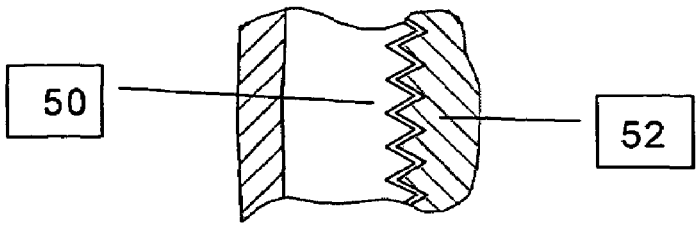
FIG. 1*a* is a cross section taken along line A-A of FIG. 1.

As illustrated in FIGS. 1*a* and 2, in order to attach or remove the lid 2 for the container 4, the rotatable piston portion 10 of the lid is rotated to a full extended position as illustrated in FIGS. 4 and 6. Once so extended, the teeth 50 configured so as to circumscribe the interior surface of the lower region of the piston actuating element section 14 engage the corresponding teeth 52 circumscribing the outer surface of the seat portion 6. Inward pressure applied to the lower area of the piston actuating element section 14 adjacent to the teeth 50 locks the teeth 50 with teeth 52, thereby allowing rotation of the seat portion 6 by rotating the rotatable piston portion 10 of the lid. It will be appreciated that the distance separating teeth 50 from teeth 52 may be such that no interlocking occurs until pressure is applied to the lower area of the piston actuating element section 14, thereby providing a childproof feature.

It will be appreciated that the above descriptions are intended only to serve as examples and that many other embodiments are possible within the spirit and the scope of the present invention.

What is claimed is:

1. A pump lid assembly for use with a container, the lid assembly comprising:

a) a pump cylinder configuration having a seat-portion for sealing connection to the container; and b) a rotatable piston portion at least a portion of said rotatable piston portion being deployed within said pump cylinder, thereby defining between them a variable pump volume;

wherein one of said pump cylinder and said rotatable piston portion includes at least one angled groove, and the other of said pump cylinder and said rotatable piston portion includes at least one pump activation pin configured to engage said angled groove, such that during rotation of said rotatable piston portion in a first rotational direction said activation pin contacts an edge of said angled groove, thereby generating linear motion of said rotatable piston portion in a first linear direction and during rotation of said rotatable piston portion in a second rotational direction said activation pin contacts an edge of said angled groove, thereby generating linear motion of said rotatable piston portion in a linear direction substantially opposite to said first linear direction, thereby alternatingly increasing and decreasing said variable pump volume, and causing displacement of gases between an interior volume of the container and an exterior atmosphere.

2. The lid assembly of claim 1, wherein an actuating element section of said rotatable piston portion substantially circumscribes at least a portion of said pump cylinder such that said rotation is about said pump cylinder.

3. The lid assembly of claim 2, wherein a wall of said pump cylinder that includes either one of said at least one angled groove, and said at least one pump activation pin configured to engage said angled groove, is a portion of said pump cylinder that together with said rotatable piston portion defines between them said variable pump volume.

4. The lid assembly of claim 1, further including a lid-removal mechanism configured to selectively limit rotation of said rotatable piston portion in relation to said seat-portion.

5. The lid assembly of claim 4, wherein said lid-removal mechanism is engaged by fully displacing said rotatable piston portion in a direction longitudinally away from the container so as to engage complementary teeth configured in both said actuating element and said seat-portion.

6. The lid assembly of claim 1, further including;

a) at least one first valve configured to allow unidirectional flow of gas between said variable pump volume and an interior volume of the container; and b) at least one second valve configured to allow unidirectional flow of gas between said variable pump volume and an external atmosphere;

wherein said alternatingly increasing and decreasing said variable pump volume causes displacement of gases through said first and said second valves.

7. The lid assembly of claim 6, wherein said at least a first valve and said at least a second valve are configured so as to pump gases out of said interior of the container and into said exterior atmosphere, thereby creating at least a partial vacuum within said interior of the container.

8. The lid assembly of claim 6, wherein said at least a first valve and said at least a second valve are configured so as to pump gases from said exterior atmosphere into said interior of the container, thereby pressurizing said interior of the container to a level above atmospheric pressure.

9. A method for actuating a pump lid assembly for use with a container, the method comprising:

a) providing a pump cylinder configuration having a seat-portion for sealing connection to the container;

b)

c) providing a rotatable piston portion least a portion of said rotatable piston portion being deployed within said pump cylinder, thereby defining between them a pump volume, wherein one of said pump cylinder and said rotatable piston portion includes at least one groove, and the other of said pump cylinder and said rotatable piston portion includes at least one pump activation pin configured to engage said groove, such that during rotation of said rotatable piston portion in a first rotational direction said activation pin contacts an edge of said groove, thereby generating linear motion of said rotatable piston portion in a first linear direction and during rotation of said rotatable piston portion in a second rotational direction said activation pin contacts an edge of said groove, thereby generating linear motion of said rotatable piston portion in a linear direction substantially opposite to said first linear. direction, thereby alternatingly increasing and decreasing said pump volume, and causing displacement of gases between an interior volume of the container and an exterior atmosphere; and d) alternately rotating said rotatable piston portion in said first and said second rotational directions.

10. The method of claim 9, further including circumscribing at least a portion of said pump cylinder with an actuating element section of said rotatable piston portion substantially such that said rotation is about said pump cylinder.

11. The method of claim 10, wherein a wall of said pump cylinder that includes either one of said at least one groove, and said at least one pump activation pin is implemented as a portion of said pump cylinder that together with said rotatable piston portion defines between them said variable pump volume.

12. The method of claim 9, further including providing a lid-removal mechanism configured to selectively limit rotation of said rotatable piston portion in relation to said seat-portion.

13. The method of claim 12, wherein engaging said lid-removal mechanism includes displacing said actuating element a pre-limited distance in a direction-longitudinally away from the container and displacing at least a portion of said actuating element inward toward said seat-portion so as to engage complementary teeth configured in both the actuating element and said seat-portion.

14. The method of claim 9, further including;

a) providing at least one first valve configured to allow unidirectional flow of gas between said pump volume and an interior volume of the container; and b) providing at least one second valve configured to allow unidirectional flow of gas between said pump volume and an external atmosphere;

wherein said alternatingly increasing and decreasing said pump volume causes displacement of gases through said first and said second valves.

15. The method of claim 14, further including configuring said at least a first valve and said at least a second valve are configured so as to pump gases out of said interior of the container and into said exterior atmosphere, thereby creating at least a partial vacuum within said interior of the container.

16. The method of claim 14, further including configuring said at least a first valve and said at least a second valve are configured so as to pump gases from said exterior atmosphere into said interior of the container, thereby pressurizing said interior of the container to a level above atmospheric pressure.

* * * * *